US006547983B2

(12) United States Patent
Iyengar

(10) Patent No.: US 6,547,983 B2
(45) **Date of Patent: *Apr. 15, 2003**

(54) DURABLE MAGNETORHEOLOGICAL FLUID COMPOSITIONS

(75) Inventor: Vardarajan R. Iyengar, Fairborn, OH (US)

(73) Assignee: Delphi Technologies, Inc., Troy, MI (US)

( * ) Notice: Subject to any disclaimer, the term of this patent is extended or adjusted under 35 U.S.C. 154(b) by 9 days.

This patent is subject to a terminal disclaimer.

(21) Appl. No.: 09/737,293

(22) Filed: Dec. 14, 2000

(65) Prior Publication Data

US 2001/0032961 A1 Oct. 25, 2001

Related U.S. Application Data

(60) Provisional application No. 60/193,914, filed on Mar. 31, 2000, provisional application No. 60/170,671, filed on Dec. 14, 1999, and provisional application No. 60/195,570, filed on Apr. 7, 2000.

(51) Int. Cl.[7] ..... H01F 1/44
(52) U.S. Cl. ..... 252/62.52
(58) Field of Search ..... 252/62.52

(56) References Cited

U.S. PATENT DOCUMENTS

| | | | | | |
|---|---|---|---|---|---|
| 2,575,360 | A | | 11/1951 | Rabinow | 252/62.52 |
| 2,772,761 | A | * | 12/1956 | Janson | 252/62.52 |
| 4,992,190 | A | | 2/1991 | Shtarkman | 252/62.52 |
| 5,167,850 | A | | 12/1992 | Shtarkman | 252/62.52 |
| 5,354,488 | A | | 10/1994 | Shtarkman | 252/62.56 |
| 5,382,373 | A | | 1/1995 | Carlson et al. | 252/62.55 |
| 5,578,238 | A | | 11/1996 | Weiss et al. | 252/62.55 |
| 5,599,474 | A | * | 2/1997 | Weiss et al. | 252/62.52 |
| 5,645,752 | A | | 7/1997 | Weiss et al. | 252/62.54 |
| 5,667,715 | A | * | 9/1997 | Foister | 252/62.52 |
| 5,670,077 | A | | 9/1997 | Carlson et al. | 252/62.52 |
| 5,683,615 | A | | 11/1997 | Munoz | 252/62.52 |
| 5,705,085 | A | | 1/1998 | Munoz et al. | 252/62.52 |
| 5,900,184 | A | | 5/1999 | Weiss et al. | 252/62.52 |
| 5,906,767 | A | | 5/1999 | Karol et al. | 252/62.52 |
| 6,027,664 | A | | 2/2000 | Weiss et al. | 252/62.52 |
| 6,149,832 | A | * | 11/2000 | Foister | 252/62.52 |
| 2001/0045540 | A1 | * | 11/2001 | Iyengar | 252/62.62 |

OTHER PUBLICATIONS

Some Material Problems in Magnetic Fluids; P.C. Scholten; Apr. 21, 1987; pp. 331–340.

* cited by examiner

*Primary Examiner*—C. Melissa Koslow
(74) *Attorney, Agent, or Firm*—Scott A. McBain

(57) ABSTRACT

A durable MR fluid formulation is described which includes mechanically hard magnetizable particles, a carrier fluid derived from a polyalphaolefin and a plasticizer, and at least one colloidal additive such as colloidal polytetrafluoroethylene or colloidal graphite. The use of these colloidal additives inhibits surface-to-surface contact and scuffing while providing reliable lubrication under boundary lubrication conditions.

12 Claims, No Drawings

DURABLE MAGNETORHEOLOGICAL FLUID COMPOSITIONS

CROSS-REFERENCE TO RELATED APPLICATIONS

This application claims the benefit of U.S. Provisional patent application Ser. No. 60/193,914, filed Mar. 31, 2000 and U.S. Provisional patent application Ser. No. 60/170,671, filed Dec. 14, 1999 and U.S. Provisional Patent Application Ser. No. 60/195,570, filed Apr. 7, 2000.

TECHNICAL FIELD

The present invention is directed to durable magnetorheological (MR) fluids containing at least one lubricative colloidal additive. The lubricative colloidal additives provide the MR fluids of the present invention with superior anti-wear and anti-friction properties. It is preferred that the lubricative colloidal additive includes colloidal polytetrafluoroethylene, colloidal graphite, colloidal molybdenum disulfide, or mixtures thereof. The MR fluids of the present invention are comprised of mechanically hard magnetizable particles, a carrier fluid derived from a polyalphaolefin and a plasticizer, and at least one colloidal additive.

BACKGROUND OF THE INVENTION

Magnetorheological (MR) fluids are substances that exhibit the rather unique property of being able to reversibly change their apparent viscosity through the application of a magnetic field. For a MR fluid, the apparent viscosity, and related flow characteristics of the fluid, can be varied by controlling the applied magnetic field. Such fluids have wide application in vibration dampening devices such as, for example, shock absorbers, vibration dampers, force/torque transfer (clutch) devices, and the like, and especially in systems in which variable control of the applied dampening/force is desirable.

MR fluids are generally suspensions of finely divided magnetizable particles in a base carrier liquid. The particles are typically selected from iron, nickel, cobalt, and their magnetizable alloys. The base carrier liquid is generally a mineral oil, synthetic hydrocarbon, water, silicone oil, esterified fatty acid or other suitable organic liquid. MR fluid generally further contains a thickener or thixotropic agent to control settling, a phosphorus additive to inhibit wear and an organomolybdenum additive to inhibit friction. A surfactant may also be added to promote dispersability of the particulates in the suspension.

The anti-wear additives used in prior art MR fluids have generally been selected from well-known anti-wear additives used in, for example, engine lubricants. These include thiophosphorus additives such as zinc dialkyl dithiophosphate (ZDDP). U.S. Pat. No. 5,683,615, for instance, describes a MR fluid comprising magnetic-responsive particles, a carrier fluid and at least one thiophosphorus or thiocarbamate; and U.S. Pat. No. 5,906,767, describes a MR fluid comprising magnetic-responsive particles, a carrier fluid and at least one phosphorus additive. Neither patent, however, discloses or suggests the use of colloidal additives in a MR fluid to inhibit wear.

The anti-friction additives used in prior art MR fluids have also been generally selected from well-known organomolybdenum compounds used as anti-friction additives in engine lubricants. For example, U.S. Pat. No. 5,705,085 describes a MR fluid that includes magnetic-responsive particles, a carrier fluid and an organomolybdenum; and U.S. Pat. No. 5,683,615 also describes the use of the same organomolybdenums in the MR fluids disclosed. Neither patent, however, discloses or suggests the use of colloidal additives in a MR fluid to inhibit friction.

The anti-wear and anti-friction additives commonly used in prior art MR fluids such as ZDDP and organomolybdenum, however, pose environmental hazards due to the presence of heavy metals. More environmentally friendly anti-wear and anti-friction additives would be preferred, but as yet, have not been found.

The present invention is directed to providing MR fluids that contain colloidal additives that will substantially replace the phosphorus-based anti-wear additives and organomolybdenum anti-friction additives typically found in prior art MR fluids.

SUMMARY OF THE INVENTION

The present invention is directed to durable MR fluid formulations comprising mechanically hard magnetizable particles, a carrier fluid derived from a polyalphaolefin and a plasticizer, and at least one colloidal additive. It has been found that durable MR fluids can be formulated that have anti-wear and anti-friction properties, but do not contain heavy metal components which are known to pose environmental hazards. The MR fluids of the present invention include at least one colloidal additive that imparts such anti-wear and anti-friction properties. While it is contemplated that any suitable colloidal additive that imparts anti-wear and anti-friction properties to the MR fluid may be used, it is preferred that the colloidal additive be selected from colloidal polytetrafluoroethylene, colloidal graphite, colloidal molybdenum disulfide, and mixtures thereof. Table 1, as follows, shows the performance of representative colloidal materials in a base oil compared against a base oil containing no additives. Results obtained from a manufacturer of such colloidal additives, (Acheson Colloids Company, Port Huron, Mich.) show that anti-wear and anti-friction properties improve with the use of such colloidal additives as compared with the base oil with no additive.

TABLE 1

| Colloidal Additive in Base Oil *** | Four Ball Wear Scar, mm (ASTM D-4172) 15 kg | 40 kg | Four Ball Extreme Pressure (ASTM D-2783) Last Non-Seizure Load, kg | Weld Load, kg | Load Wear Index | Falex Pin & Vee Block Wear (ASTM-D-2670) Number of Teeth | Extreme Pressure (ASTM D-333) Failure Load, lb | Kinetic Friction Coefficient |
|---|---|---|---|---|---|---|---|---|
| Base Oil - No Additive | 0.678 | 1.060 | 40 | 126 | 17.2 | Failed 350 lb break-in load @ 1–2 min. into test | 750 | 0.159 |
| PTFE | 0.678 | 0.890 | 40 | 200 | 27.6 | 10 | 4250 | 0.094 |

TABLE 1-continued

| Colloidal Additive in Base Oil *** | Four Ball Wear Scar, mm (ASTM D-4172) 15 kg | 40 kg | Four Ball Extreme Pressure (ASTM D-2783) Last Non-Seizure Load, kg | Weld Load, kg | Load Wear Index | Falex Pin & Vee Block Wear (ASTM-D-2670) Number of Teeth | Extreme Pressure (ASTM D-333) Failure Load, lb | Kinetic Friction Coefficient |
|---|---|---|---|---|---|---|---|---|
| $MoS_2$ | 0.630 | 0.805 | 40 | 250 | 24.3 | 8 | 4375 | 0.114 |
| Graphite | 0.675 | 0.855 | 40 | 160 | 18.7 | 78 | 1250 | 0.123 |

*** Unless otherwise noted, all dispersions were diluted to 1% solids in base oil The colloidal additives, as contemplated for use in the durable MR fluids of the present invention, inhibit surface-to-surface contact and scuffing while providing reliable lubrication under boundary lubrication conditions.

DESCRIPTION OF THE PREFERRED EMBODIMENT

The MR fluids of the present invention are comprised of mechanically hard magnetizable particles, a carrier fluid derived from a polyalphaolefin and a plasticizer, and at least one lubricative colloidal additive.

The colloidal additives as used in the present invention include colloidal polytetrafluoroethylene, colloidal graphite, colloidal molybdenum disulfide, and similar colloidal compositions that would be appreciated by those of skill in the art. These colloidal additives, used individually or in combinations, impart both anti-wear and anti-friction properties to the MR fluids of the present invention and can substantially replace or reduce the use of known prior art additives such as ZDDP and organomolybdenums. These colloidal additives further provide the MR fluids of the invention with extreme pressure and load carrying properties that can result in smoother operation, extended life and reduced maintenance of the vibration dampening devices in which they are used.

The preferred colloidal additive may be selected from one or more of the following: colloidal polytetrafluoroethylene (PTFE), colloidal graphite, colloidal molybdenum disulfide, or mixtures thereof. Colloidal PTFE suitable for use in the present invention is preferably a dispersion of fine particles in any convenient non-aqueous media, e.g., synthetic or mineral base oil, compatible with the remainder of the formulation. The preferred average particle size is in the range of from about 0.05 to about 4.0 microns. Commercial colloidal PFTE dispersions which may suitably be used in the present invention include Acheson SLA 1612 and Acheson SLA 1614.

Colloidal graphite suitable for use in the present invention is preferably a suspension of uniform colloidal graphite particles in a highly refined synthetic or petroleum oil. The preferred average particle size is in the range of from about 0.1 to about 1.0 microns. A commercial colloidal graphite suspension which is suitable for use in the present invention is Acheson SLA 1275.

A colloidal molybdenum disulfide may also be used in the invention. It is preferably a stable dispersion of uniform microscopic molybdenum disulfide particles in a highly refined synthetic or petroleum oil concentrate. The preferred solids content of the colloidal molybdenum disulfide dispersion is in the range of about 25 to about 35 percent by volume. A commercial colloidal molybdenum disulfide dispersion which may suitably be used in the present invention is Acheson SLA 1286.

When used in combinations, it is preferred that the PTFE be used in each blended combination. For example, it is preferred that the SLA 1286 and/or the SLA 1275 be blended with the SLA 1614 for a combination PTFE-graphite and/or molybdenum disulfide product. All of the above Acheson products are available from Acheson Colloids Company, Port Huron, Mich.

The colloidal additive, as used in the present invention, is used in an amount based upon the total weight of the primary liquid components (the polyalphaolefin (PAO) and the plasticizer). As contemplated, the weight fraction of the colloidal additives to the PAO and plasticizer is in the range of about 0.001 to about 0.2, and preferably in the range of about 0.01 to about 0.15. In a preferred embodiment, the colloidal additive is polytetrafluoroethylene used in a weight fraction of about 0.10.

The magnetizable particles of the invention generally include all magnetizable metal and metal alloy particles having a hardness of greater than about B50 on the Rockwell scale (hardness of reduced carbonyl iron) and preferably having a hardness of up to about C65 on the Rockwell scale (with C65 representing the hardness of tool steel). The metals specifically contemplated include unreduced carbonyl iron (having a hardness of greater than about B50 to about C65 on the Rockwell scale) and iron-cobalt alloys. Examples of preferred carbonyl irons include, BASF grades HS, HL, HM, HF and HQ, and International Specialty Products (ISP) grades S-3700, S-1640 and S-2701. An example of a preferred cobalt-iron alloy is Carpenter Technology grade HYPERCO™. Preferably, the metal particles are selected from the group consisting of unreduced carbonyl iron particles, cobalt-iron alloy particles, and mixtures thereof.

It is also recognized that similar results could be obtained with iron particles that have hardness somewhat less than C65 but significantly greater than B50 to about C65 on the Rockwell scale. Pure iron is soft and ductile; the hardness of iron is increased by the addition of small quantities of impurities such as Nitrogen and Carbon. For example, reduced carbonyl iron such as BASF grade CM contains 0.008% Carbon and 0.01% Nitrogen, whereas unreduced carbonyl iron such as BASF grade HS contains 0.74% Carbon and 0.78% Nitrogen. It is believed that iron powders containing intermediate levels of Carbon (greater than 0.008% and less than 0.74%) and Nitrogen (greater than 0.01% and less than 0.78%) may also perform well and are specifically contemplated in the present invention.

In a MR fluid of the present invention, the amount of magnetizable particle used is a volume fraction of the total volume of the fluid, and is in the range of about 0.1 to about 0.6, with a preferred range of about 0.15 to about 0.3. The nominal particle size of the magnetizable particles should be no greater than about 10 microns, preferably less than about 5 microns, and most preferably about 1–2 microns.

The carrier fluid of the present invention comprises a polyalphaolefin (PAO) and a plasticizer. Preferred PAO's include dimers and trimers of decene and dodecene, such as Chevron Synfluid™ 2.5 (a dimer of 1-dodecene), Chevron Synfluid™ 2 (a dimer of decene), Chevron Synfluid™ 4 (a trimer of decene), Mobil PAO SHF 21 (a dimer of decene), Mobil PAG SHF 41 (a trimer of decene) and Amoco Durasyn™ 170. Preferably, the polyalphaolefin is selected from the group consisting of dimers and trimers of decene, dimers and trimers of dodecene, and mixtures thereof. Even more preferably, the carrier fluid consists essentially of a mixture of a dimer of 1-dodecene and dioctyl sebacate in a volume ratio of about 4. It is also preferable that the plasticizer be selected from the group consisting of dioctyl, sebacate, dioctyl adipate, mixed alkyl adipate diesters, hindered polyol esters and mixtures thereof.

It has been found that while PAO is an excellent carrier fluid, over time, it tends to slightly shrink the fluid seals used in most MR dampening devices. To counteract this effect, it has been discovered that an important component in the formulation of durable MR fluids is a plasticizer that acts to provide seal swell. It has also been found that the use of a plasticizer can provide additional advantages with respect to durability because by regulating seal swell the plasticizer can help to accommodate for the loss of seal material resulting from wear. Preferred plasticizers include dioctyl sebacates, dioctyl adipates, mixed alkyl adipate diesters and hindered polyol esters. Examples of such preferred plasticizers include UNIFLEX™ DOS, UNIFLEX™ DOA, UNIFLEX™ 250 and UNIFLEX™ 207-D, all available from Arizona Chemical. The amount of the PAO to plasticizer used in the invention is a volume ratio of PAO to DOS in the range of about 1 to about 10, and preferably in the range of about 3 to about 6. It is preferred that a dioctyl sebacate such as UNIFLEX™ DOS, available from Arizona Chemical may be used.

A thixotropic agent may also be used. The preferred thixotrope is untreated fumed silica that is produced by the vapor phase hydrolysis of silicon tetrachloride in a hydrogen oxygen flame. The preferred thixotrope also has a surface area greater than about 300 $m^2/g$ and more preferably of between about 300 $m^2/g$ to about 350 $m^2/g$. The process creates three-dimensional chain-like aggregates of sintered silicon dioxide particles having a length of about 0.2 to about 0.3 microns. In the present invention, grades of untreated fumed silica having a surface area of greater than or equal to about 300 $m^2/g$ are preferred. Examples of such untreated fumed silicas include CAB-O-SIL® grades EH-5, HS-5, H-S and MS-55, available from Cabot Corporation.

The amount of untreated fumed silica used in the present invention is a weight fraction of the total weight of the liquid components and ranges from about 0.01 to about 0.1, with the preferred range being about 0.03 to about 0.05. The preferred grade of untreated silica has a surface area of greater than about 350 $m^2/g$ such as, for example, CAB-O-SIL® EH-5.

The MR fluids of the present invention may further include minor amounts of anti-wear and anti-friction agents known in the art. The amount of each of these additives, as used in the present invention, is dependent upon the total weight of the PAO and the plasticizer, the primary liquid components. It is contemplated that the weight fraction of the anti-wear additive to the PAO and the plasticizer should be in the range of about 0 to about 0.03 and the weight fraction of the anti-friction additive to the PAO and the plasticizer should be in the range of about 0 to about 0.03. Examples of anti-wear agents include zinc dialkyl dithiophosphate (ZDDP) such as available from Lubrizol Corporation (e.g., grades 1395 and 677A) and Ethyl Corporation (e.g., grades HiTEC™ 7197 and HiTEC™ 680). Examples of anti-friction agents include organomolybdenums (MOLY) such as NAUGALUBE™ MOLYFM 2543 available from C. K. Witco and MOLYVAN™ 855 available from R. T. Vanderbilt Company and alkyl amine oleates.

The MR fluids of the present invention may optionally include an amine for use in combination with the untreated fumed silica. In non-hydrogen bonding liquids, such as PAO, the addition of amines improve the thixotropic efficiency of the untreated fumed silica by acting as bridging compounds between the surface hydroxyls of adjacent silica aggregates, extending the distance at which they can hydrogen bond. In the present invention, the preferred amine is an ethoxylated amine which is used in an amount based on the weight of the untreated fumed silica used. The weight fraction of the ethoxylated amine is in the range of about 0 to about 0.3, wherein the preferred weight fraction is in a range of about 0.1 to about 0.15. Examples of suitable ethoxylated amines include, Ethomeen™ C-15, T-15 and S-15 from Akzo Nobel Chemicals Inc., and Tomah Products Inc.'s grades E-14-5, E-17-5 and E-S-2. The preferred ethoxylated amine for use in the present invention is Ethomeen™ C-15.

Examples 1–5, below, are representative MR fluids of the present invention that contain lubricative colloidal additives. It should, however, be appreciated that these examples are provided for illustration only and are not intended in any way to limit the scope of the present invention.

In the examples, the iron powder is unreduced carbonyl iron, BASF grade HS; the PAO is Chevron Synfluid™ 2.5; the DOS (plasticizer) is Uniflex™ DOS; the fumed silica (thixotrope) is CAB-O-SIL® EH-5; the colloidal PFTE is Acheson SLA 1614; the colloidal graphite is Acheson SLA 1275; the colloidal molybdenum disulfide is Acheson SLA 1286; and the C-15 refers to Ethomeen™ C-15 (an ethoxylated amine).

Example 1
MR Fluid with PTFE

| Component | Weight, g |
|---|---|
| Iron Powder | 5791.05 |
| Fumed Silica | 101.80 |
| PAO | 1732.37 |
| DOS | 480.63 |
| Colloidal PTFE | 331.95 |
| Colloidal Graphite | 0 |
| C-15 | 0 |

Example 2
MR Fluid with PTFE and C-15

| Component | Weight, g |
|---|---|
| Iron Powder | 5791.05 |
| Fumed Silica | 101.85 |
| PAO | 1726.31 |
| DOS | 478.95 |
| Colloidal PTFE | 330.79 |
| Colloidal Graphite | 0 |
| C-15 | 10.18 |

Example 3
MR Fluid with PFTE, Graphite and C-15

| Component | Weight, g |
|---|---|
| Iron Powder | 5791.05 |
| Fumed Silica | 101.65 |
| PAO | 1722.87 |
| DOS | 477.99 |
| Colloidal PTFE | 220.09 |
| Colloidal Graphite | 110.04 |
| C-15 | 10.16 |

Examle 4
MR Fluid with PFTE, $MoS_2$, and C-15

| Component | Weight, g |
|---|---|
| Iron Powder | 5791.05 |
| Fumed Silica | 102.47 |
| PAO | 1736.79 |
| DOS | 481.85 |
| Colloidal PTFE | 221.86 |
| Colloidal $MoS_2$ | 110.93 |
| C-15 | 10.25 |

Example
MR Fluid with $MoS_2$, Graphite and C-15

| Component | Weight, g |
|---|---|
| Iron Powder | 5791.05 |
| Fumed Silica | 102.06 |
| PAO | 1729.84 |
| DOS | 479.92 |
| Colloidal $MoS_2$ | 110.49 |
| Colloidal Graphite | 220.98 |
| C-15 | 10.21 |

The MR fluids of these examples are formulated as follows. For a 1 gallon batch, the liquid components (PAO, DOS, the colloidal additive, and optionally the C-15) are first mixed together under low shear conditions of about 200 to about 500 rpm. The fumed silica is then added to the liquid components and mixed for an additional 20 minutes. Following this mixing step, the iron powder is slowly added while continuously mixing, and then mixing is continued for about 1 hour or until the iron powder is thoroughly dispersed, whichever is greater. The fluid composition is then subjected to high shear mixing at about 2500 to about 3500 rpm for about 10 to about 30 minutes.

While the preferred embodiment of the present invention has been described so as to enable one skilled in the art to practice the durable magnetorheological fluid compositions, it is to be understood that variations and modifications may be employed without departing from the concept and intent of the present invention as defined by the following claims. The preceding description is intended to be exemplary and should not be used to limit the scope of the invention. The scope of the invention should be determined only by reference to the following claims.

What is claimed:

1. A durable magnetorheological fluid comprising:

a. mechanically hard magnetizable particles having a hardness greater than B50 on the Rockwell scale and a particle size less than about 10 microns that is selected from the group consisting of unreduced carbonyl iron particles, cobalt iron alloy particles, and mixtures thereof;

b. a carrier fluid consisting essentially of a mixture of a dimer of dodecene and dioctyl sebacate;

c. untreated fumed silica having a surface area of between about 300 $m^2/g$ to about 350 $m^2/g$; and d. a colloidal additive selected from colloidal polytetrafluoroethylene, colloidal graphite or mixtures thereof.

2. A magnetorheological fluid of claim 1 wherein said particles have an average particle size of less than about 5 microns.

3. A magnetorheological fluid of claim 2 wherein said particles are unreduced carbonyl iron having a hardness greater than B50 to about C65 on the Rockwell Scale.

4. A magnetorheological fluid of claim 3 wherein said particles of said unreduced carbonyl iron have a hardness of about C65 on the Rockwell Scale.

5. A magnetorheological fluid of claim 2 wherein said particles are a cobalt-iron alloy.

6. A magnetorheological fluid of claim 1 wherein said carrier fluid consists essentially of a mixture of a dimer of 1-dodecene and dioctyl sebacate in a volume ratio of about 4.

7. A magnetorheological fluid of claim 1 wherein said colloidal additive is colloidal polytetrafluoroethylene.

8. A magnetorheological fluid of claim 1 wherein said colloidal additive is colloidal graphite.

9. A magnetorheological fluid of claim 1 further comprising an anti-wear additive and an anti-friction additive.

10. A magnetorheological fluid comprising:

a. mechanically hard magnetizable particles of unreduced carbonyl iron having a hardness of about C65 on the Rockwell Scale and an average particle size of about 1 to 2 microns;

b. a carrier fluid consisting essentially of a mixture of a dimer of 1-dodecene and dioctyl sebacate in a volume ratio of about 4;

c. untreated fumed silica having a surface area of about 350 $m^2/g$;

d. a colloidal additive selected from colloidal polytetrafluoroethylene, colloidal graphite or mixtures thereof; and e. an ethoxylated amine.

11. A magnetorheological fluid of claim 10 wherein said colloidal additive is colloidal polytetrafluoroethylene.

12. A magnetorheological fluid of claim 10 wherein said colloidal additive is colloidal graphite.

* * * * *